US006216479B1

(12) United States Patent
Elwood

(10) Patent No.: US 6,216,479 B1
(45) Date of Patent: Apr. 17, 2001

(54) PROGRAMMABLE ELECTRONIC START-UP DELAY FOR REFRIGERATION UNITS

(75) Inventor: Bryan M. Elwood, Candler, NC (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/638,057

(22) Filed: Aug. 11, 2000

Related U.S. Application Data

(63) Continuation of application No. 09/332,524, filed on Jun. 14, 1999, now Pat. No. 6,119,469.

(51) Int. Cl.[7] ..... F25B 49/00

(52) U.S. Cl. ..... 62/230; 62/126; 62/127; 62/158; 62/175; 307/40; 307/41

(58) Field of Search ..... 62/126, 158, 157, 62/230, 175, 127; 307/38, 40, 41

(56) References Cited

U.S. PATENT DOCUMENTS

| | | |
|---|---|---|
| 3,422,633 | 1/1969 | Bodett . |
| 4,177,388 | 12/1979 | Lingenfelter . |
| 4,749,881 | 6/1988 | Uhrich . |
| 5,119,014 | 6/1992 | Kronberg . |
| 5,216,897 | 6/1993 | Tsuchiyama . |
| 5,365,747 | 11/1994 | Werbowsky et al. . |
| 5,454,229 | 10/1995 | Hanson et al. . |
| 5,524,448 | 6/1996 | Schwanebeck et al. . |
| 5,782,098 | 7/1998 | Hirooka et al. . |
| 6,119,469 | 9/2000 | Elwood . |

*Primary Examiner*—Corrine McDermott
*Assistant Examiner*—Marc Norman
(74) *Attorney, Agent, or Firm*—Pepper Hamilton LLP

(57) ABSTRACT

A programmable electronic start-up delay for delaying the start-up of refrigeration units (10, 12, 14) for a user-programmable variable delay period. The delay permits a group of refrigeration units all powered by the same source (16) to be restarted at different time intervals after a power failure to prevent overloading of the power source or associated circuitry.

11 Claims, 2 Drawing Sheets

PROGRAMMABLE ELECTRONIC START-UP DELAY FOR REFRIGERATION UNITS

RELATED APPLICATIONS

This application is a continuation of and claims priority of the non-provisional application entitled Programmable Electronic Start-up Delay for Refrigeration Units, Ser. No. 09/332,524, filed Jun. 14, 1999, now U.S. Pat. No. 6,119,469.

BACKGROUND OF THE INVENTION

1. Field of the Invention

The present invention relates to laboratory refrigeration units designed for refrigerating and freezing laboratory samples. More particularly, the invention relates to a programmable electronic start-up delay for delaying the start-up of refrigeration units after a power failure for a user-programmable variable delay period so that a group of refrigeration units can be restarted at different time intervals.

2. Description of the Prior Art

Laboratory refrigeration units such as ultra low temperature freezers are used to freeze or refrigerate laboratory samples such as tissue, blood and plasma. Laboratory samples are often held in these types of refrigeration units for years; therefore, it is critical that the units always remain in operation.

Facilities using a plurality of these types of refrigeration units are subject to potential catastrophic shutdowns during power failures. Specifically, if a plurality of refrigeration units all connected to the same power circuit attempt to restart after a power failure, the power circuit will likely be overloaded and will trip a breaker or fuse and/or fail entirely. This would result in a long-term shutdown of the refrigeration units, causing the laboratory samples contained therein to be damaged.

It is known to delay the start-up of a group of refrigeration units with solid-state delay devices placed in the circuit supplying power to the units. These prior art delay devices are not entirely satisfactory, however, because they are costly, difficult to install, and take up valuable space. Moreover, it is difficult or impossible to modify the start-up delay time period of these prior art devices after they are installed.

OBJECTS AND SUMMARY OF THE INVENTION

The present invention solves the above-described problems and provides a distinct advance in the art of refrigeration units. More particularly, the present invention provides a programmable electronic start-up delay for refrigeration units that is embodied in software run by a processor residing directly on each refrigeration unit. The software permits a user to enter a variable start-up delay period for a particular refrigeration unit directly at that refrigeration unit. This allows the entry of a different delay period for each refrigeration unit connected to the same power circuit so that the units can be restarted at different time intervals after a power failure, thus staggering the start-up times of the units.

In preferred forms, the software triggers an enunciator or display on each refrigeration unit when the unit is in an active delay period prior to start-up to alert an operator of the status of the unit. The software may also trigger a display on each unit to countdown the delay period so that an operator knows exactly when each unit will re-start.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
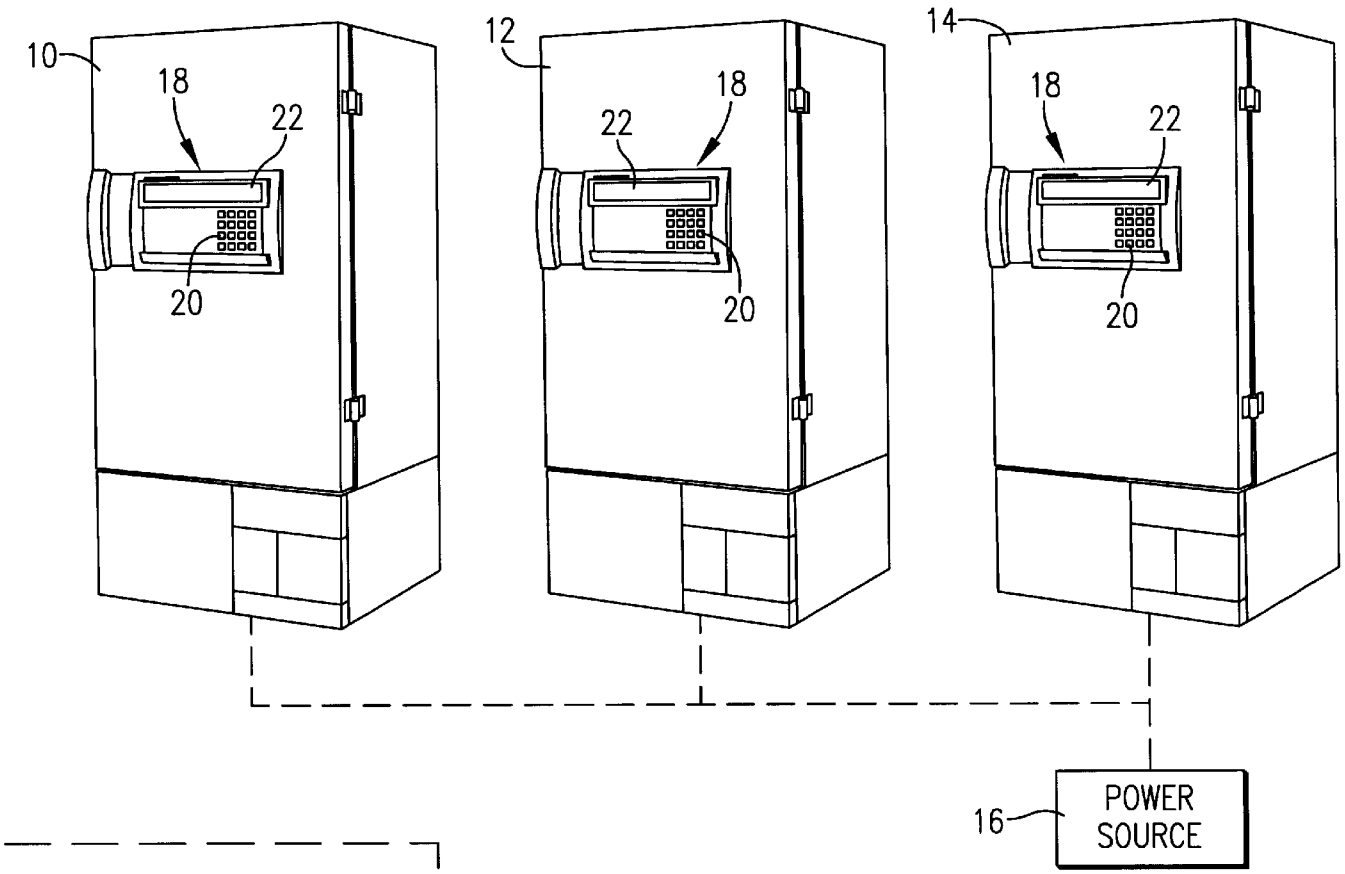
FIG. 1 is a schematic diagram illustrating several refrigeration units connected to a single power source.
Figure 2:
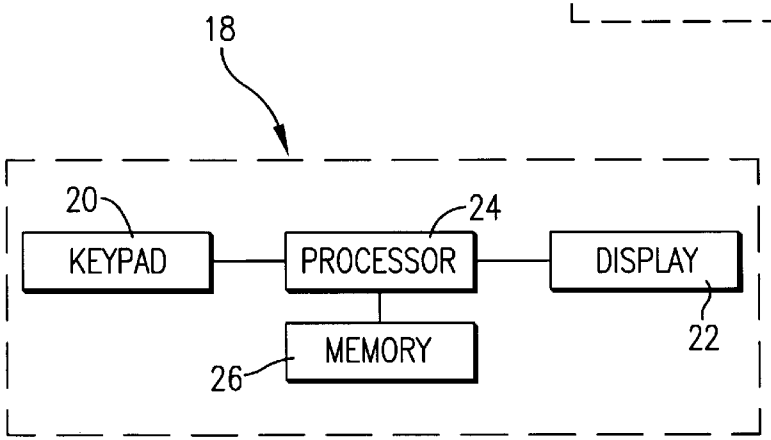
FIG. 2 is a block diagram illustrating certain components contained in a user interface positioned on each of the refrigeration units.

Turning now to the drawing figures, and particularly FIGS. 1 and 2, the present invention is preferably implemented in a plurality of refrigeration units 10, 12, 14 such as those manufactured by General Signal Laboratory Equipment, Inc. The refrigeration units each include a conventional compressor and are all connected in a conventional manner to a single power source 16 such as a 120v or 480v AC power circuit. The present invention may be implemented with any number of refrigeration units connected to one or more power sources.

Each of the refrigeration units preferably includes a user interface 18 having, among other components, an alphanumeric keypad 20 or other input device, a display 22, a processor 24, and memory 26 coupled with the processor. The processor receives instructions from the keypad, controls operation of the display, and stores information in the memory to control start-up of the compressor or other major load of its refrigeration unit as described below.

Figure 3:
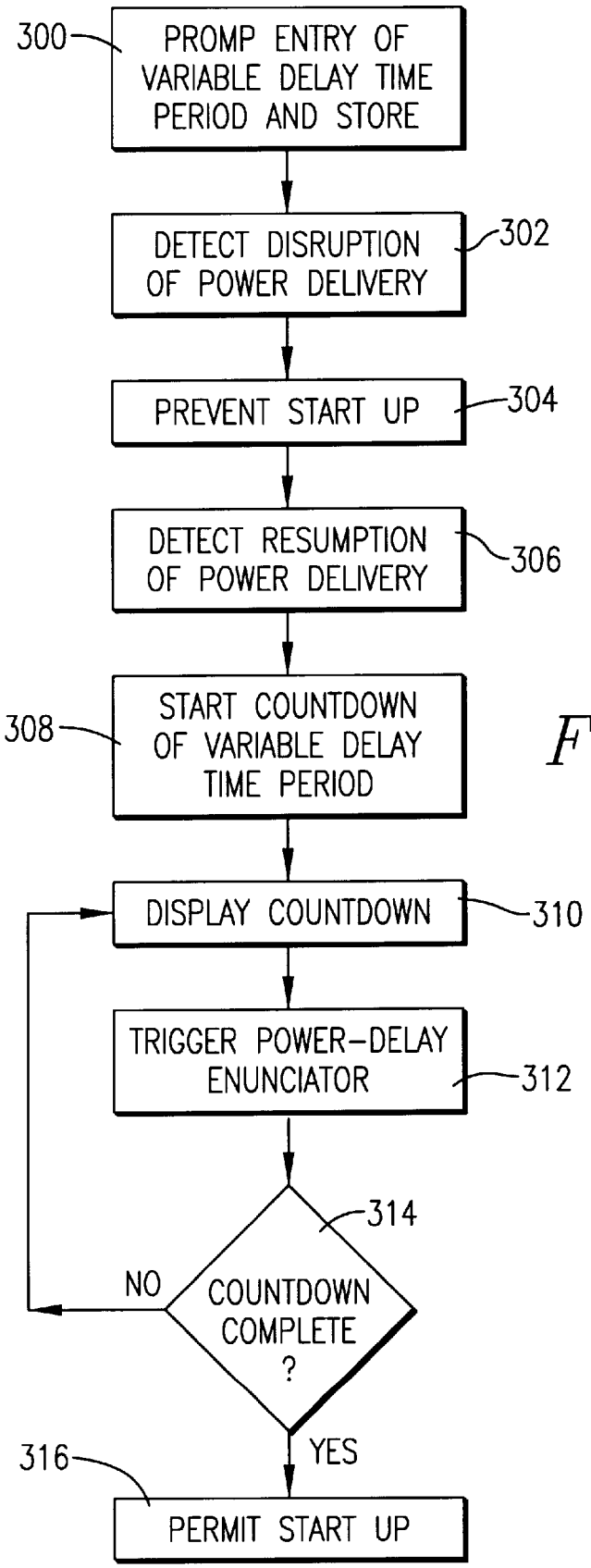
FIG. 3 is a flow diagram generally illustrating the steps of a preferred embodiment of the present invention.

In accordance with the present invention, the start-up times of the refrigeration units 10, 12, 14 after a power failure or shut down are controlled by software or firmware stored in the processor 24 and/or memory 26 of the user interfaces 18. The software may be written in any computer language as a matter of design choice. FIG. 3 broadly illustrates the steps performed by the software for one of the refrigeration units. The software is identical for each refrigeration unit except for certain user programmable values described herein.

To add start-up delay capabilities to a refrigeration unit, certain parameters must be initially set up in the software. To this end, the processor 24 for the unit first prompts an operator to enter a variable delay time period as depicted in step 300 of FIG. 3. The prompt preferably consists of a message displayed on the display 22 of the user interface 18 that directs the user to enter a delay time period. Once a delay time period has been entered, it is stored in the memory 26 of the user interface.

The delay time period, which is initially set to 0 for each refrigeration unit as a default, should be set so that each refrigeration unit restarts at a different time after a power failure or shut down. For example, the delay time period for the refrigeration unit 10 may be set to 15 seconds, the delay time period for the refrigeration unit 12 may be set to 30 seconds, and the delay time period for the refrigeration unit 14 may be set to 45 seconds.

The software next moves to step 302 where the processor 24 monitors power delivery to the refrigeration unit to detect any disruption of power delivery to the unit. Until a power disruption is detected, the processor allows the compressor or other load of the unit to cycle on and off in a conventional manner strictly based on measured temperature or other variable.

Once the processor 24 detects a power disruption, it prevents start-up of the compressor or other load as depicted in step 304. This prevents the compressor or other load from immediately restarting after power delivery has resumed. The processor may prevent such start-up in any conventional manner such as by triggering a relay that is wired between the compressor or other load and the source of power.

The software next moves to step 306 where the processor 24 monitors power delivery to the refrigeration unit to detect resumption of power delivery to the unit. At this point, the processor still prevents start-up of the compressor or other load of the unit.

Once the processor 24 detects a resumption of power, the software moves to step 308 where it starts to count down the variable delay time period entered in step 300. Alternatively, the processor may start a clock or counter after power resumes to count the time after the resumption of power delivery. The processor then displays the countdown or the clock as depicted in 310 and triggers a power-delay enunciator as depicted in step 312 to alert an operator of the status of the refrigeration unit.

The software next moves to step 314 where it determines whether the countdown has expired orwhether the clock time equals the entered variable delay time period. If it does not, the software loops back through steps 310 and 312 until it does.

Once the countdown is complete or the clock equals the variable delay time period, the software moves to step 316 where the processor 24 permits start-up of the compressor or other major load of the refrigeration unit. This permits the refrigeration units to be restarted at different, user-defined time intervals after a power failure to stagger the start-up times of the units, thus reducing the initial current draw on the power circuit. As described above, the processor may permit such start-up by triggering a power relay wired between the compressor or other load and the power source.

Once the unit has been re-started, the software loops back to step 302 to wait for another disruption of power delivery to the refrigeration unit. The steps illustrated in FIG. 3 are repeated for each of the refrigeration units so that each unit has its own, unique variable delay time period.

Although the invention has been described with reference to the preferred embodiment illustrated in the attached drawing figures, it is noted that equivalents may be employed and substitutions made herein without departing from the scope of the invention as recited in the claims. For example, although the start-up delay features of the present invention are preferably implemented in a plurality of refrigeration units, it may also be implemented in other types of devices that draw a large amount of current at start-up.

Having thus described the preferred embodiment of the invention, what is claimed as new and desired to be protected by Letters Patent includes the following:

1. A method of controlling start-up of an electrically powered device, the method comprising the steps of:

(a) receiving a delay value in an electrical signal from an input device and storing the delay value;

(b) detecting a disruption of power delivery to the electrically powered device;

(b) detecting a resumption of power delivery;

(c) measuring a period of time following resumption of power delivery, the length of the period of time being determined by the delay value; and (d) preventing start-up of the electrically powered device until after the period of time has been measured following the resumption of power delivery.

2. A variable delay restart apparatus for regulating the start-up of an electrically powered device following an interruption in power delivery to the electrically powered device, the apparatus comprising:

a controller operable to receive and store input which will determine the length of a delay period, sense a disruption of power delivery, sense a resumption of power delivery, measure the delay period, and initiate a restart of the electrically powered device; and an input device operable to provide input in the form of an electrical signal to the controller.

3. The variable delay restart apparatus of claim 2, the input device being an alphanumeric keypad.

4. The variable delay restart apparatus of claim 2, further comprising a status interface operable to communicate visually information regarding the operation of the variable delay restart apparatus and the powered device.

5. The variable delay restart apparatus of claim 4, the status interface being further operable to communicate audibly.

6. The variable delay restart apparatus of claim 2, the controller being implemented as program code stored on computer readable memory and run on a microprocessor.

7. The variable delay restart apparatus of claim 2, the electrically powered device being a refrigeration unit.

8. A method of controlling start-up of an electrically powered device, the method comprising the steps of:

(a) detecting a disruption of power delivery to the electrically powered device;

(b) detecting a resumption of power delivery;

(c) measuring a predetermined period of time following resumption of power delivery; and (d) preventing start-up of the electrically powered device until after the period of time has been measured following the resumption of power delivery; and (e) communicating both visually and audibly information regarding the operation of the variable delay restart apparatus and the powered device.

9. A variable delay restart apparatus for regulating the start-up of an electrically powered device following an interruption in power delivery to the electrically powered device, the apparatus comprising:

a controller operable to receive and store input which will determine the length of a delay period, sense an interruption in power delivery, measure the delay period, and initiate a restart of the powered device; and an interface operable to communicate both visually and audibly information regarding the operation of the variable delay restart apparatus and the powered device.

10. The variable delay restart apparatus of claim 9, the controller being implemented as program code stored on computer readable memory and run on a microprocessor.

11. The variable delay restart apparatus of claim 9, the electrically powered device being a refrigeration unit.

* * * * *